US008596930B2

(12) United States Patent
Woudenberg et al.

(10) Patent No.: US 8,596,930 B2
(45) Date of Patent: Dec. 3, 2013

(54) DEGRADABLE EROSION CONTROL BARRIER

(75) Inventors: Walter van Woudenberg, Edmonton (CA); Ian Wilson, Edmonton (CA)

(73) Assignee: Nilex Inc., Edmonton, Alberta (CA)

( * ) Notice: Subject to any disclaimer, the term of this patent is extended or adjusted under 35 U.S.C. 154(b) by 1618 days.

(21) Appl. No.: 11/746,869

(22) Filed: May 10, 2007

(65) Prior Publication Data

US 2008/0279639 A1 Nov. 13, 2008

(51) Int. Cl.
*E02D 17/20* (2006.01)

(52) U.S. Cl.
USPC ..... 405/302.6; 405/302.7

(58) Field of Classification Search
USPC ..... 405/15, 302.6, 302.7; 523/124, 125, 523/126; 524/320, 394
See application file for complete search history.

(56) References Cited

U.S. PATENT DOCUMENTS 4,292,365 A 9/1981 Kane et al.
4,339,114 A 7/1982 Deike
5,039,250 A 8/1991 Janz
5,854,304 A 12/1998 Garcia et al.
2002/0098040 A1* 7/2002 Doolittle ..... 405/15
2006/0280923 A1* 12/2006 Fleck-Arnold et al. ..... 428/220

FOREIGN PATENT DOCUMENTS

CA 1304975 7/1992

* cited by examiner

*Primary Examiner* — Benjamin Fiorello
(74) *Attorney, Agent, or Firm* — Terrence N. Kuharchuk; Rodman & Rodman

(57) ABSTRACT

An erosion control barrier for installation in a drainage path in a service environment. The erosion control barrier includes a unitary permeable sheet which is bent along a longitudinal axis to provide an upslope side, a downslope side and a longitudinally extending apex. The permeable sheet is constructed of a degradable material so that the erosion control barrier has a design service life in the service environment and a design material life in the service environment. The design material life is longer than the design service life. The permeable sheet is designed to be sufficiently transversely stiff and resilient during the design service life to enable the erosion control barrier to be self-supporting. The permeable sheet is designed to substantially disintegrate within the design material life.

14 Claims, 2 Drawing Sheets

DEGRADABLE EROSION CONTROL BARRIER

FIELD OF INVENTION

A degradable erosion control barrier.

BACKGROUND OF THE INVENTION

Barrier systems have a variety of uses in a wide range of industries. Their uses include: protection of soil from water or wind erosion, protection of crops and plants from wind, sand trapping for dune or beach development, dust control, snow fences, livestock fences, water diversion, berms for storage of water or other liquids, silt fences and canal systems for water transport or liquid waste transport.

The design of such barrier systems depends to a large extent on their application. For example, sediment control barriers include the use of straw bales secured end to end and to the ground perpendicularly across the flow of water, sand bags piled on top of each other and aligned end to end perpendicularly across the flow of water, various kinds of log and stone barriers, cross trenches, terraced slopes, various kinds of concrete structures and gabions.

Sediment control barriers also include filter fences, constructed of filter fabric, posts and wire fences. These are single vertical barriers made from a fabric supported in an upright position by posts and support mesh. Another design is a brush filter barrier made from a filter fabric draped over a brush barrier.

Another kind of barrier used for erosion control includes a matting or blanket, for example a weaved matting, placed directly on the ground. Small grains or grasses grow up through the weave of the matting to form the barrier. Such a flexible fabric blanket or mat is disclosed in U.S. Pat. No. 4,292,365 (Kane et al). In an alternative form, the flexible fabric blanket may be wrapped around itself and placed vertically upward in a ditch to form a 3-ply vertical barrier.

A further use of barriers is for snow fencing. U.S. Pat. No. 4,339,114 (Dieke), discloses a snow fence made of a framing structure for supporting a fence face between spaced upright members. A mesh is placed over the frame, and angled supports on the leeward side of the fence support the fence. The angled supports attach to the upright posts at intermediate points on the upright posts.

These barriers suffer from certain disadvantages. The snow fence described in U.S. Pat. No. 4,339,114 (Dieke) is complex and expensive to build. For use in roadside erosion control applications, hay bales suffer the disadvantage of quickly disintegrating, rock piles and other rigid barriers are dangerous to motor vehicles that leave the road, and vertical fences are difficult to maintain, in that they tend to collapse under the weight of sediment.

U.S. Pat. No. 5,039,250 (Janz) discloses a barrier system for installation adjacent a roadway, which barrier system is comprised of a permeable sheet having a unitary structure and being folded about a longitudinal axis to form an apex, the permeable sheet having an upslope side and a downslope side and being transversely stiff at least on either side of the apex, and having first and second longitudinal edges on the upslope side and the downslope side, at least the longitudinal edge on the upslope side being secured in the ground, and the permeable sheet having a mesh size selected to discriminate against a chosen size of particles, whereby the mesh sheet is collapsible under the weight of impact of a vehicle.

The barrier system disclosed in U.S. Pat. No. 5,039,250 (Janz) has enjoyed commercial success and may in fact be retrieved and reused when it is no longer needed in a particular location. However, in some applications, reusing the barrier system is unnecessary or impractical, with the result either that the barrier system is retrieved only to be discarded, or that the barrier system is left in place and effectively becomes waste or garbage and presents an environmental problem.

The present invention is directed at a barrier system of the general type disclosed in U.S. Pat. No. 5,039,250 (Janz) which is constructed of a degradable material which will enable the barrier system to perform its functions during a service life and which will degrade so that the barrier system does not need to be retrieved and so that the barrier system does not present an environmental problem.

SUMMARY OF THE INVENTION

The present invention is an erosion control barrier that is simple, easy to install, and which has a design service life and a design material life.

In one aspect, the invention is an erosion control barrier for installation in a drainage path in a service environment, the erosion control barrier comprising a unitary permeable sheet which is bent along a longitudinal axis to provide an upslope side, a downslope side and a longitudinally extending apex, the permeable sheet being constructed of a degradable material so that the erosion control barrier has a design service life in the service environment and a design material life in the service environment, wherein the design material life is longer than the design service life, wherein the permeable sheet is designed to be sufficiently transversely stiff and resilient during the design service life to enable the erosion control barrier to be self-supporting, and wherein the permeable sheet is designed to substantially disintegrate within the design material life.

The permeable sheet has a first longitudinal edge on the upslope side and a second longitudinal edge on the downslope side. The permeable sheet may be bent adjacent to one or both of the first longitudinal edge and the second longitudinal edge to provide a longitudinally extending lip.

The length of the design service life and the design material life of the erosion control barrier is typically dependent upon the service environment to which the erosion control barrier is exposed. In many applications of the invention, the service environment is an outdoor environment.

The service environment may subject the erosion control barrier to environmental conditions which may assist in the degradation of the degradable material. The environmental conditions may, for example, be comprised of one or more of oxygen, heat, ultraviolet (UV) radiation, and/or mechanical stress. Many or all of these environmental conditions may be present in an outdoor environment.

The length of the design service life of the erosion control barrier may be any length of time which is sufficient to enable the erosion control barrier to fulfill its intended purpose or purposes. Where an intended purpose of the erosion control barrier is to enable vegetation to establish adjacent to the erosion control barrier, a suitable design service life of the erosion control barrier in the service environment may, for example, be about 18-24 months or about 1-2 growing seasons. In other applications of the invention, the design service life in the service environment may be less than 18 months or greater than 24 months.

The minimum length of the design material life of the erosion control barrier may be any length of time which does not interfere with the design service life of the erosion control barrier. Where an intended purpose of the erosion control barrier is to enable vegetation to establish adjacent to the erosion control barrier and the design service life of the erosion control barrier in the service environment is about 18-24 months or about 1-2 growing seasons, the length of the design material life of the erosion control barrier in the service environment is preferably less than about 60 months and more preferably no greater than about 48 months, and preferably no less than about 36 months.

The design service life of the erosion control barrier is the length of time during which the erosion control barrier may be expected to be self-supporting and thus capable of performing its intended function or functions in the service environment. The design material life of the erosion control barrier is the length of time in which the permeable sheet will substantially disintegrate in the service environment. The actual service life and the actual material life of the erosion control barrier may be less than or greater than the design service life and the design material life, depending upon the service environment and the environmental conditions to which the erosion control barrier is exposed.

The degradable material may be comprised of any material or combination of materials which can provide the design service life and the design material life. In some applications, the degradable material may be comprised of a commodity plastic and a degradation additive which causes the commodity plastic to degrade. The degradable material may be a mixture of the commodity plastic and the degradation additive.

In some applications, the commodity plastic may be polyethylene. In some applications the polyethylene may be high density polyethylene.

Where the degradable material is comprised of a commodity plastic and a degradation additive, the degradation additive may be any substance or combination of substances which may be added to the commodity plastic to cause the commodity plastic to substantially disintegrate within a design material life which is a relatively short period of time in comparison with the material life of a commodity plastic which does not include the degradation additive, without substantially interfering with the design service life of the erosion control barrier.

Where the degradable material is comprised of a commodity plastic and a degradation additive, the degradation additive may be comprised of an additive package or additive concentrate as described in U.S. Pat. No. 5,854,304 (Garcia et al), issued to EPI Environmental Products Inc. on Dec. 29, 1998.

Where the degradable material is comprised of a commodity plastic and a degradation additive, the degradation additive may be comprised of a metal carboxylate and an aliphatic poly hydroxyl-carboxyl acid, and may be further comprised of calcium oxide and/or stabilizers and/or oxidizers, as described in U.S. Pat. No. 5,854,304 (Garcia et al).

Where the degradable material is comprised of a commodity plastic and a degradation additive, the degradation additive may be comprised of a TDPA™ additive available from EPI Environmental Plastics Inc. of Conroe, Tex. or EPI Environmental Products Inc. of Vancouver, British Columbia (collectively "EPI").

In some applications the TDPA™ additive may be a DCP™ additive from EPI, such as DCP™ 565 (formerly named ZSK™ 1314 by EPI) or DCP™ 564 (formerly named ZSK™ 1370 by EPI).

Where the degradable material is comprised of a commodity plastic and a degradation additive, the design service life and the design material life of the erosion control barrier is dependent upon the composition of the commodity plastic, the composition of the degradation additive, the amount of the degradation additive, and upon the service environment of the erosion control barrier. As a result, a desired design service life and a desired design material life can be achieved by selecting the composition of the commodity plastic, the composition of the degradation additive and the amount of the degradation additive, having regard to the service environment.

Where the degradable material is comprised of a commodity plastic and a degradation additive, the degradable material may be comprised of any suitable amount of degradation additive which provides the desired design service life and desired design material life.

In embodiments where the degradable material is comprised of a commodity plastic and a TDPA™ additive from EPI, such as DCP™ 565 (formerly named ZSK™ 1314 by EPI) or DCP™ 564 (formerly named ZSK™ 1370 by EPI), the degradable material is preferably comprised of no greater than about 15 percent by weight of the degradation additive, more preferably no greater than about 10 percent by weight of the degradation additive, even more preferably between about 2-10 percent by weight of the degradation additive, and most preferably about 5 percent by weight of the degradation additive. Notwithstanding these preferred amounts, the amount of the degradation additive is preferably selected having regard to the desired service life and the desired material life of the erosion control barrier in the service environment.

BRIEF DESCRIPTION OF THE DRAWINGS

Embodiments of the invention will now be described with reference to the accompanying drawings, in which.

DETAILED DESCRIPTION

Figure 1:
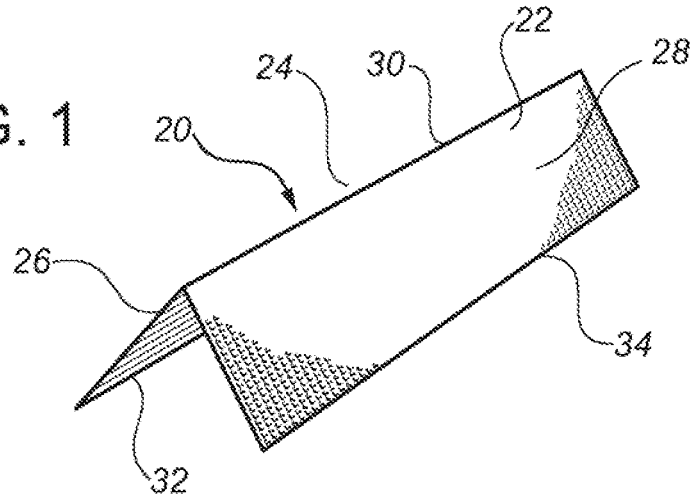
FIG. 1 is a pictorial view of a first embodiment of an erosion control barrier according to the invention.
Figure 2:
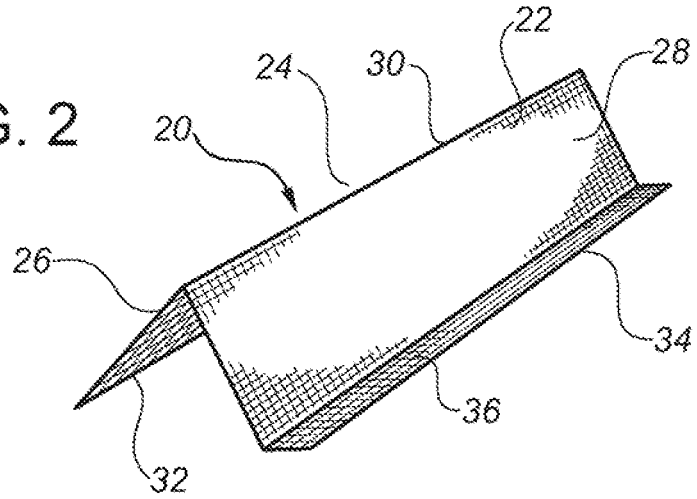
FIG. 2 is a pictorial view of a second embodiment of an erosion control barrier according to the invention.
Figure 3:
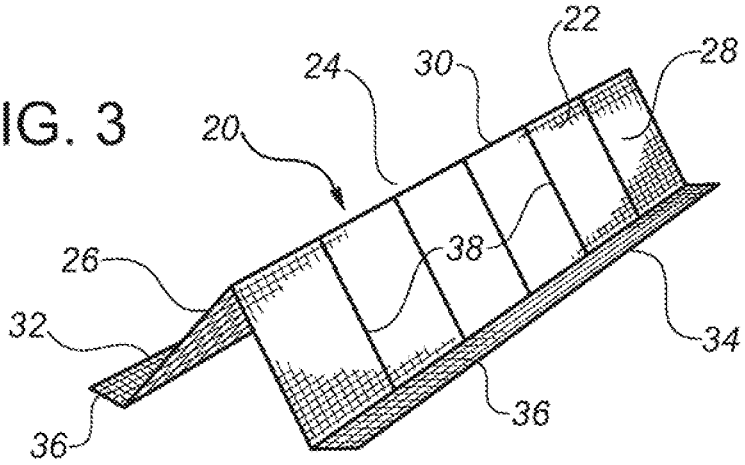
FIG. 3 is a pictorial view of a third embodiment of an erosion control barrier according to the invention.

FIGS. 1-3 illustrate three embodiments of an erosion control barrier constructed according to the invention. The embodiments shown are primarily intended for use in the prevention of excessive erosion in roadside drainage ditches and on earth construction grades. The erosion control barrier is particularly suited for use in newly created drainage ditches and on newly formed construction grades where vegetation has not yet become established. In the description that follows, like reference numbers are used to describe like features in the three embodiments.

Referring to FIGS. 1-3, an erosion control barrier (20) is comprised of a unitary permeable sheet (22). As used herein, "unitary' means that the permeable sheet (22) is either formed from a single piece of material or is formed from a plurality of pieces of material which are permanently connected together such as by gluing, welding etc. The permeable sheet (22) or its pieces or components may be formed by molding, extruding, or by any other suitable manufacturing technique. In the embodiments depicted in FIGS. 1-5, the permeable sheet (22) is preferably formed from a single piece of material by injection molding.

The permeable sheet (22) is bent along a longitudinal axis (24) to provide an upslope side (26), a downslope side (28), and a longitudinally extending apex (30). The permeable sheet (22) may be folded to provide the bend, the permeable sheet (22) may be formed with the bend, or the bend may be provided by permanently connecting together the upslope side (26) and the downslope side (28) as two separate pieces of material.

The permeable sheet (22) has a porosity so that the permeable sheet (22) is permeable. The porosity may be provided in any suitable manner. As non-limiting examples, the porosity may be provided by forming the permeable sheet (22) with holes, by forming the permeable sheet (22) as a mesh material, or by creating holes in the permeable sheet (22) after it is formed.

The permeable sheet (22) has a first longitudinal edge (32) on the upslope side (26) and a second longitudinal edge (34) on the downslope side (28). Referring to FIG. 2 and FIG. 3, the permeable sheet (22) may be bent adjacent to either or both of the first longitudinal edge (32) and the second longitudinal edge (34) to provide a longitudinally extending lip (36).

In FIG. 2, a single lip (36) is provided adjacent to the second longitudinal edge (34) so that the lip is associated with the downslope side (28) of the permeable sheet (22). The lip (36) as depicted in FIG. 2 may assist in dissipating energy of runoff water, thereby reducing the amount of erosion which occurs on the downslope side (28) of the permeable sheet (22). In FIG. 3, lips (36) are provided adjacent to each of the first longitudinal edge (32) and the second longitudinal edge (34). In addition to dissipating energy of runoff water, the lip (36) in FIG. 2 and the lips (36) in FIG. 3 provide bearing surfaces for the permeable sheet (22).

Referring to FIG. 3, the erosion control barrier (20) may be further comprised of one or more reinforcing ribs (38) for providing additional strength and rigidity to the permeable sheet (22). The reinforcing ribs (38) may be included as a component of the "unitary" permeable sheet (22), or the reinforcing ribs (38) may be separate from the permeable sheet (22).

Figure 4:
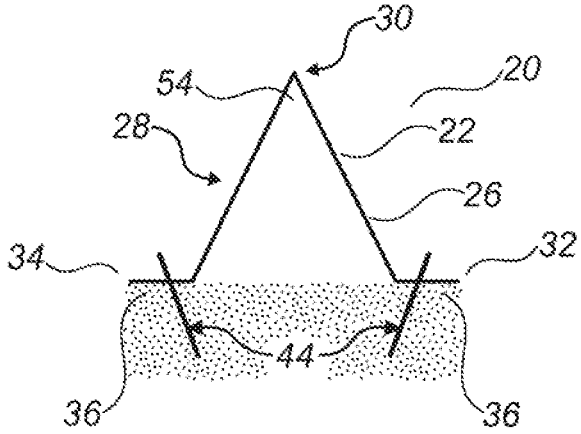
FIG. 4 is a side schematic view of an erosion control barrier as depicted in FIG. 3, shown in service along a drainage path.
Figure 5:
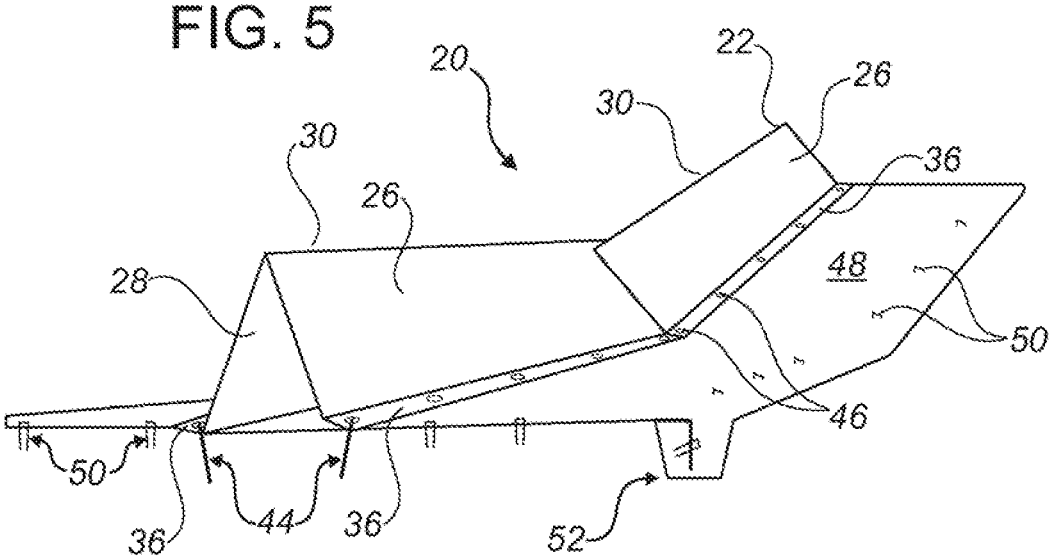
FIG. 5 is a schematic pictorial view of two erosion control barriers as depicted in FIG. 3, shown in an end to end overlapping configuration in service along a drainage path.

Referring to FIG. 4 and FIG. 5, one or more of the erosion control barriers (20) may be placed in service to reduce or prevent erosion and/or movement of soil along a drainage path (40). The soil may include rocks, sand, silt, clay, organic matter or any other solid material which may be contained within the runoff water.

In order to perform this function, one or more erosion control barriers (20) may be oriented transversely across the drainage path (40) so that water and soil first contacts the upslope side (26) of the permeable sheet (22). Where more than one erosion control barrier (20) is used, the erosion control barriers (20) may be oriented in succession along the drainage path (40) so that they are generally parallel to each other and generally perpendicular to the direction of flow along the drainage path (40). Alternatively or additionally, a plurality of erosion control barriers (20) may be positioned in an end to end overlapping configuration as shown in FIG. 5 so that a wider section of the drainage path (40) may be covered by the erosion control barriers (20).

The erosion control barriers (20) positioned in a particular drainage path (40) may be identical to each other or may have varying physical dimensions. For example, the erosion control barriers (20) may have the same or varying lengths and/or heights. Varying lengths of erosion control barrier (20) may be useful for different applications, and the use of shorter length overlapping erosion control barriers (20) may be preferable in some applications to the use of a single longer erosion control barrier (20), since shorter length erosion control barriers (20) may more easily conform to the drainage path (40). In the embodiments contemplated in FIGS. 1-5, the typical length of the erosion control barrier (20) is about 1 meter.

In general, the pore size of the permeable sheet (22) is selected so that runoff water will be able to flow through the permeable sheet (22) and so that at least some of the energy of the runoff water dissipates as the runoff water flows through the permeable sheet (22), without causing significant damming of the runoff water or an excessive amount of trapping of soil by the permeable sheet (22). In the embodiments depicted in FIGS. 1-5, the pore size of the permeable sheet (22) is preferably between about 6 millimeters and about 10 millimeters. For example, it has been found that a pore size of about 6 millimeters×8 millimeters is suitable for use in the invention.

Larger or smaller pore sizes may, however, be provided in the permeable sheet (22) to suit a particular application, and a variety of pore sizes may be employed in a single permeable sheet (22) or in different permeable sheets (22).

Similarly, the porosity of the permeable sheet (22) is selected to provide a chosen resistance to flow of water and soil through the erosion control barrier (20). As a result, each permeable sheet (22) in an installation may have the same or varying porosities. For example, if a succession of erosion control barriers (20) is positioned along the length of a drainage path (40), relatively lower porosity may be provided in the permeable sheets (22) of downstream erosion control barriers (20) to account for dissipation of water and soil along the drainage path (40). In the embodiments depicted in FIGS. 1-3, a representative porosity of the permeable sheet (22) is between about 30 percent and about 45 percent, or more preferably between about 35 percent and about 40 percent. Higher or lower porosities may, however, be provided in the permeable sheet (22) to suit a particular application.

In service, the erosion control barrier (20) may be fixed to a ground surface (42) using one or more anchors (44). The anchors (44) may be comprised of bolts, stakes, spikes or any other suitable device. As shown in FIG. 4 and FIG. 5, the lip (36) in FIG. 2 and/or the lips (36) in FIG. 3 may provide a convenient location for insertion of the anchors (42). Anchor holes (46) may be provided in the lips (36) for this purpose.

Referring to FIG. 5, a drainage path (40) may be prepared before installation of erosion control barriers (20). Specifically, an erosion control blanket (48) may be placed in the drainage path (40) and may be anchored to the ground surface (42) with staples (50) or some other suitable anchoring mechanism. A trench (52) may also be dug adjacent to an upstream edge (54) of the erosion control blanket (48) and the upstream edge (54) may be secured in the trench (52) with staples (50) or some other suitable anchoring mechanism, following which the trench (52) may be backfilled and recompacted. The erosion control barrier (20) or erosion control barriers (20) may then be placed on top of the erosion control blanket (48) and fixed to the ground surface (42) using the anchors (44).

The erosion control barrier (20) is designed to provide a design service life in a service environment, during which the physical properties of the erosion control barrier (20) are suitable for its intended use. The most important physical property of the erosion control barrier (20) during its design service life is that the erosion control barrier (20) must be sufficiently transversely stiff and resilient to enable the erosion control barrier (20) to be self-supporting.

As used herein, "self-supporting" means that the erosion control barrier (20) will substantially maintain its shape while in service as it supports its own weight and the weight of soil which may become deposited on or adjacent to the erosion control barrier (20), and as it withstands the forces which are exerted on the erosion control barrier (20) by runoff water, wind etc.

In order for the erosion control barrier (20) to be self-supporting, it must exhibit adequate resistance to collapsing either by buckling of the upslope side (26) or the downslope side (28) of the permeable sheet (22) or by "opening" of the apex (30) of the permeable sheet (22). The erosion control barrier (20) must also exhibit adequate resilience in that the permeable sheet (22) must be capable of reasonable elastic and/or plastic deformation without fracturing. In other words, the permeable sheet (22) must be relatively non-brittle during the service life of the erosion control barrier (20).

The ability of the erosion control barrier (20) to be self-supporting is dependent upon the properties of the material which is used to construct the permeable sheet (22), the configuration of the permeable sheet (22) and is also dependent upon the size, shape and configuration of the erosion control barrier (20).

As one example, the apex (30) of the permeable sheet (22) forms an angle (54) between the upslope side (26) and the downslope side (28) of the permeable sheet (22). Increased resistance to "opening" of the apex (30) may be achieved by minimizing the size of the angle (54). Preferably the angle (54) is less than about 90 degrees in order to minimize the risk of opening of the apex (30). However, as the angle (54) is reduced, the erosion control barrier (20) will become inherently less stable. As a result, preferably the angle (54) is between about 60 degrees and about 90 degrees in order to optimize the ability of the erosion control barrier (20) to be self-supporting.

As a second example, increased resistance to buckling of the upslope side (26) and the downslope side (28) of the permeable sheet (22) may be achieved by managing the height of the erosion control barrier (20). In the embodiments contemplated in FIGS. 1-5, the height of the erosion control barrier (20) is less than about 0.30 meters.

As a third example, the ability of the permeable sheet (22) to be self-supporting may be enhanced by providing the permeable sheet (22) with the reinforcing ribs (38).

Optionally, in addition to being self-supporting, the erosion control barrier (20) may be designed so that it is collapsible under the weight of a vehicle which may strike the erosion control barrier (20). This optional feature is particularly advantageous from a safety perspective for applications in which the erosion control barrier (20) is deployed adjacent to a roadway. This optional feature may be inherent in the choice of material or materials for the erosion control barrier (20) and in the choice of size, shape and configuration of the erosion control barrier (20).

As indicated above, the ability of the erosion control barrier (20) to be self-supporting is also dependent upon the material which is used to construct the permeable sheet (22). The present invention is directed at providing that the erosion control barrier (20) has suitable material properties to be self-supporting during its design service life in the service environment, and at also providing that the permeable sheet (22) will disintegrate within a design material life within the service environment.

In order to achieve this stated object of the invention, the permeable sheet (22) is constructed of a degradable material. In the embodiments contemplated in FIGS. 1-5, the degradable material is preferably comprised of a commodity plastic and a degradation additive which together provide a degradable plastic.

As used herein, a "commodity plastic" includes any plastic resin or plastic polymer of the type which may typically be used to construct articles having the required properties of the erosion control barrier (20) during its design service life, including, for example polypropylene, polyethylene (including low density polyethylene and high density polyethylene) and polystyrene.

In the embodiments contemplated in FIGS. 1-5, the commodity plastic is preferably polyethylene, and more preferably, high density polyethylene.

In the embodiments contemplated in FIGS. 1-5, the degradation additive is an additive which can be incorporated into the commodity plastic to render the commodity plastic degradable.

As used herein, a "degradable plastic" is a plastic which is designed to undergo a significant change in its chemical structure which ultimately results in substantial disintegration of the plastic within a material life which is a relatively short period of time in comparison with a conventional plastic. As used herein, "substantial disintegration" means that the degradable material either is reduced to fragments or is sufficiently brittle so that it may be reduced to fragments upon the application of moderate mechanical stress.

The degradation of the plastic may be effected by a chemical reaction involving the plastic, by the actions of naturally-occurring organisms such as bacteria, fungi and/or algae, or by a combination of effects. For example, in some applications of the invention, the degradation of the plastic may be the result of oxidative degradation due to reaction of the plastic with oxygen, by biodegradation due to consumption of the plastic by organisms, or by a combination of oxidative degradation and biodegradation.

The length of the design material life of the degradable plastic is typically dependent upon the composition of the degradable material and upon the service environment to which the degradable material is exposed. For example, the presence of oxygen, heat, ultraviolet (UV) radiation and mechanical stress are all factors which can influence the design material life of a degradable plastic. As a result, a measure of design material life is made with reference to the intended service environment of the erosion control barrier (20) and with reference to the expected environmental conditions of the intended service environment.

In embodiments of the invention in which the degradable material is a degradable plastic, the degradable plastic must enable the erosion control barrier (20) to be self-supporting during its design service life while causing the permeable sheet (22) to substantially disintegrate within the design material life.

In embodiments in which the degradable material is comprised of a commodity plastic and a degradation additive, the degradation additive may be comprised of an additive package and/or additive concentrate as described in U.S. Pat. No. 5,854,304 (Garcia et al), issued to EPI Environmental Products Inc. on Dec. 29, 1998, which patent is hereby incorporated by reference.

More particularly, the additive package and/or additive concentrate described in U.S. Pat. No. 5,854,304 is comprised of a metal carboxylate and an aliphatic poly hydroxyl-carboxyl acid, and may be further comprised of calcium oxide and/or stabilizers and/or oxidizers as described therein. Additive packages and additive concentrates of the type described in U.S. Pat. No. 5,854,304 may be obtained from EPI Environmental Plastics Inc. of Conroe, Tex. or EPI Environmental Products Inc. of Vancouver, British Columbia (collectively "EPI").

In preferred embodiments of the present invention, the degradable material is comprised of high density polyethylene and a TDPA™ (Totally Degradable Plastic Additives) degradation additive obtained from EPI. It has been found that suitable TDPA™ additives include DCP™ 565 (formerly named ZSK™ 1314 by EPI) and DCP™ 564 (formerly named ZSK™ 1370 by EPI). It is believed that the TDPA™ degradation additives cause degradation of the plastic by a combination of oxidative degradation due to reaction of the plastic with oxygen and biodegradation due to consumption of the plastic by organisms, both of which are believed to be facilitated by the TDPA™ degradation additives.

The design service life of the erosion control barrier (20) may generally be designed to enable the erosion control barrier (20) to fulfill its intended purpose or purposes. For example, the erosion control barrier (20) may be designed to be self-supporting long enough to enable vegetation in the drainage path (40) to become sufficiently established so that the erosion control barrier (20) is no longer needed. As a result, the degradable material is designed so that the extent of degradation of the permeable sheet (22) before the end of the design service life does not substantially interfere with the function or functions of the erosion control barrier (20).

The design material life of the erosion control barrier (20) may generally be designed so that the permeable sheet (22) will substantially disintegrate within a reasonable period of time after the end of the design service life. The minimum design material life may be any length of time which does not interfere with the design service life of the erosion control barrier (20).

In many applications of the erosion control barrier (20), a design service life of about 18-24 months or 1-2 growing seasons may be desirable. In many applications, a design material life of about 36 months, 48 months or 60 months may be desirable. Since the design service life and the design material life are both dependent upon the service environment and the environmental conditions of the service environment, the actual service life and the actual material life may be less than or greater than the design service life and the design material life.

It has been found in testing that a design service life of about 18-24 months and a design material life of less than about 60 months for the erosion control barrier (20) in an outdoor environment as the service environment can be expected to be achieved by combining about 2-10 percent DCP™ 565 or DCP™ 564 degradation additive by weight with about 90-98 percent high density polyethylene as the commodity plastic by weight, or most preferably about 5 percent DCP™ 565 or DCP™ 564 degradation additive by weight with about 95 percent high density polyethylene by weight.

However, the design service life and the design material life of the erosion control barrier (20) is dependent upon the composition of the commodity plastic, upon the composition of the degradation additive, upon the amount of the degradation additive, and upon the intended service environment. As a result, the design service life and the design material life of the degradable material may be tailored to a specific application through the selection of the commodity plastic, the degradation additive, and the amount of the degradation additive, having regard to the intended service environment.

In all applications of the erosion control barrier (20) of the invention, the permeable sheet (22) is constructed of a degradable material. Optionally, other components of the erosion control barrier (20) or components associated with the erosion control barrier (20) may be constructed of a degradable material. For example, the anchors (44), the erosion control blanket (48) and/or the staples (50) may be constructed of a degradable material. If reinforcing ribs (38) are provided and are not a unitary component of the permeable sheet (22), the reinforcing ribs (38) may be constructed of a degradable material. Preferably, the same degradable material is used for all components of the erosion control barrier (20) and all components associated with the erosion control barrier (20).

The advantage of the present invention is that the erosion control barrier (20) may be deployed in a drainage path (40) to prevent erosion and to facilitate the establishment of vegetation in the drainage path during the service life of the erosion control barrier (20) as a natural erosion control mechanism. Following the service life of the erosion control barrier (20), it is not necessary to retrieve the erosion control barrier (20), since the erosion control barrier (20) will degrade and ultimately disintegrate within the material life of the erosion control barrier (20).

While certain embodiments of the present invention have been described in the foregoing, it is to be understood that other embodiments are possible within the scope of the invention.

Modifications that are substantially the same as the present invention may occur to a person skilled in the art, and these are intended to be included within the scope of the claims that follow.

Finally, in this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. An erosion control barrier for installation in a drainage path in a service environment, the erosion control barrier comprising a unitary permeable sheet which is bent along a longitudinal axis to provide an upslope side, a downslope side and a longitudinally extending apex, the permeable sheet being constructed of a degradable material so that the erosion control barrier has a design service life in the service environment and a design material life in the service environment, wherein the design material life is longer than the design service life, wherein the permeable sheet is designed to be sufficiently transversely stiff and resilient during the design service life to enable the erosion control barrier to be self-supporting, wherein the permeable sheet is designed to substantially disintegrate within the design material life and wherein the degradable material is comprised of a commodity plastic and a degradation additive which causes the commodity plastic to degrade.

2. The erosion control barrier as claimed in claim 1 wherein the permeable sheet has a first longitudinal edge on the upslope side, wherein the permeable sheet has a second longitudinal edge on the downslope side, and wherein the permeable sheet is bent adjacent to at least one of the first longitudinal edge and the second longitudinal edge to provide a longitudinally extending lip.

3. The erosion control barrier as claimed in claim 2 wherein the length of the design material life is dependent upon the service environment.

4. The erosion control barrier as claimed in claim 2 wherein the service environment is an outdoor environment and wherein the length of the design material life is less than about 60 months.

5. The erosion control barrier as claimed in claim 2 wherein the service environment is an outdoor environment and wherein the length of the design material life is less than about 48 months.

6. The erosion control barrier as claimed in claim 2 wherein the commodity plastic is polyethylene.

7. The erosion control barrier as claimed in claim 6 wherein the commodity plastic is high density polyethylene.

8. The erosion control barrier as claimed in claim 2 wherein the degradation additive is comprised of a metal carboxylate and an aliphatic poly hydroxy-carboxyl acid.

9. The erosion control barrier as claimed in claim 8 wherein the degradable material is comprised of less than about 10 percent by weight of the degradation additive.

10. The erosion control barrier as claimed in claim 8 wherein the degradation additive is further comprised of calcium oxide.

11. The erosion control barrier as claimed in claim 8 wherein the commodity plastic is polyethylene.

12. The erosion control barrier as claimed in claim 11 wherein the commodity plastic is high density polyethylene.

13. The erosion control barrier as claimed in claim 12 wherein the degradable material is comprised of less than about 10 percent by weight of the degradation additive.

14. The erosion control barrier as claimed in claim 12 wherein the degradation additive is further comprised of calcium oxide.

* * * * *